US008973284B2

(12) United States Patent
Shami et al.

(10) Patent No.: US 8,973,284 B2
(45) Date of Patent: Mar. 10, 2015

(54) HAIR DRYER

(75) Inventors: Farouk M. Shami, The Woodlands, TX (US); Dennis R. Morrison, Seabrook, TX (US); Thong Thu Pham, Houston, TX (US)

(73) Assignee: Farouk Systems, Inc., Houston, TX (US)

( * ) Notice: Subject to any disclaimer, the term of this patent is extended or adjusted under 35 U.S.C. 154(b) by 557 days.

(21) Appl. No.: 12/684,003

(22) Filed: Jan. 7, 2010

(65) Prior Publication Data

US 2010/0170104 A1 Jul. 8, 2010

Related U.S. Application Data

(60) Provisional application No. 61/143,057, filed on Jan. 7, 2009.

(51) Int. Cl.

| | |
|---|---|
| ***F26B 7/00*** | (2006.01) |
| ***A45D 20/12*** | (2006.01) |
| ***A45D 20/00*** | (2006.01) |
| ***F26B 3/34*** | (2006.01) |

(52) U.S. Cl.

CPC ..... *A45D 20/12* (2013.01); *A45D 2200/202* (2013.01); *A45D 2200/205* (2013.01)

USPC ..... 34/380; 34/97; 34/283; 34/275

(58) Field of Classification Search

USPC ..... 34/96, 97, 283, 275, 380; 219/222, 225, 219/227, 228

See application file for complete search history.

(56) References Cited

U.S. PATENT DOCUMENTS

| | | | | |
|---|---|---|---|---|
| 4,185,316 | A * | 1/1980 | Fleck | 361/230 |
| 5,302,190 | A * | 4/1994 | Williams | 95/57 |
| 5,805,406 | A * | 9/1998 | Mailand | 361/212 |
| 6,941,675 | B2 * | 9/2005 | Slingo | 34/96 |
| 7,047,660 | B2 * | 5/2006 | Leventhal | 34/97 |
| 7,328,708 | B2 * | 2/2008 | Malak | 128/898 |
| 7,485,833 | B2 * | 2/2009 | Lin | 219/548 |
| 2005/0011533 | A1 * | 1/2005 | Ruben | 132/230 |
| 2005/0198855 | A1 * | 9/2005 | Cafaro et al. | 34/97 |
| 2005/0274965 | A1 * | 12/2005 | Phillips et al. | 257/94 |
| 2008/0145485 | A1 * | 6/2008 | Tepper et al. | 426/92 |
| 2008/0276479 | A1 * | 11/2008 | Byun et al. | 34/97 |

FOREIGN PATENT DOCUMENTS

| | | | |
|---|---|---|---|
| JP | 408047415 | A | 2/1996 |
| JP | 2003189925 | A * | 7/2003 |

* cited by examiner

*Primary Examiner* — Kenneth Rinehart
*Assistant Examiner* — John McCormack
(74) *Attorney, Agent, or Firm* — George P. Kobler; Lanier Ford Shaver & Payne P.C.

(57) ABSTRACT

A hair dryer apparatus and method for use in hair care. The apparatus preferably includes a nozzle, a housing, an ion generator disposed within the housing, and an ozone generator disposed within the housing. Further, disposed within the apparatus may be a circuit board, which is in electronic communication with at least three control buttons, a microprocessor, a liquid crystal display, and a voltage regulator.

12 Claims, 3 Drawing Sheets

HAIR DRYER

CROSS REFERENCE TO RELATED APPLICATIONS

This application claims the benefit and priority benefit, of U.S. Provisional Patent Application No. 61/143,057 filed on Jan. 7, 2009.

BACKGROUND OF THE INVENTION

1. Field of the Invention

The present disclosure relates generally to the care and enhancement of hair. More specifically, the present disclosure relates to a hair dryer for styling, drying, and enhancing hair.

2. Description of the Related Art

There has long been a desire to dry and style hair. Prior hair dryers are generally known.

SUMMARY OF THE INVENTION

In accordance with the illustrative embodiments hereinafter described, a hair dryer may include a nozzle and a housing. The hair dryer may further include an ion generator disposed within the housing and an ozone generator disposed within the housing.

According to another illustrative embodiment, a hair dyer may include a nozzle and a housing. Further disposed within the housing may be a circuit board, at least three control buttons, a microprocessor, at least one liquid crystal display, and a voltage regulator. The at least three control buttons, the microprocessor, the liquid crystal display, and the voltage regulator may be in electrical, or electronic, communication.

In accordance with another illustrative embodiment, a method of using a hair dryer is provided. The hair dryer may have a housing and a plurality of control buttons, including an up control button and a down control button, associated with the housing, and a plurality of available functions associated with the plurality of control buttons. The method may further include depressing a control button to select a function of the hair dryer from the plurality of available functions, and depressing either an up or down control button to select the desired function of the hair dryer In accordance with another illustrative embodiment, a method of sanitizing a hair dryer is provided. The hair dryer may have a nozzle, a housing, an ozone producing component disposed within at least a portion of the housing, and a plurality of ultra-violet light emitting diodes associated with at least a portion of the housing. The method may include operating the ozone producing component to produce a sufficient amount of ozone for a sufficient amount of time to sanitize at least a portion of the housing. The method may further include operating the ultra-violet light emitting diodes to emit a sufficient amount of ultra-violet light for a sufficient amount of time to sanitize at least a portion of the housing.

While certain embodiments of the present hair dryer will be described in connection with the preferred illustrative embodiments shown herein, it will be understood that it is not intended to limit the invention to those embodiments. On the contrary, it is intended to cover all alternatives, modifications, and equivalents, as may be included within the spirit and scope of the invention as defined by the appended claims. In the drawing figures, which are not to scale, the same reference numerals are used throughout the description and in the drawing figures for components and elements having the same structure.

BRIEF DESCRIPTION OF THE DRAWING

The present hair dryer and method of using a hair dryer may be understood by reference to the following description taken in conjunction with the accompanying drawing, in which.

DETAILED DESCRIPTION

Figure 1:
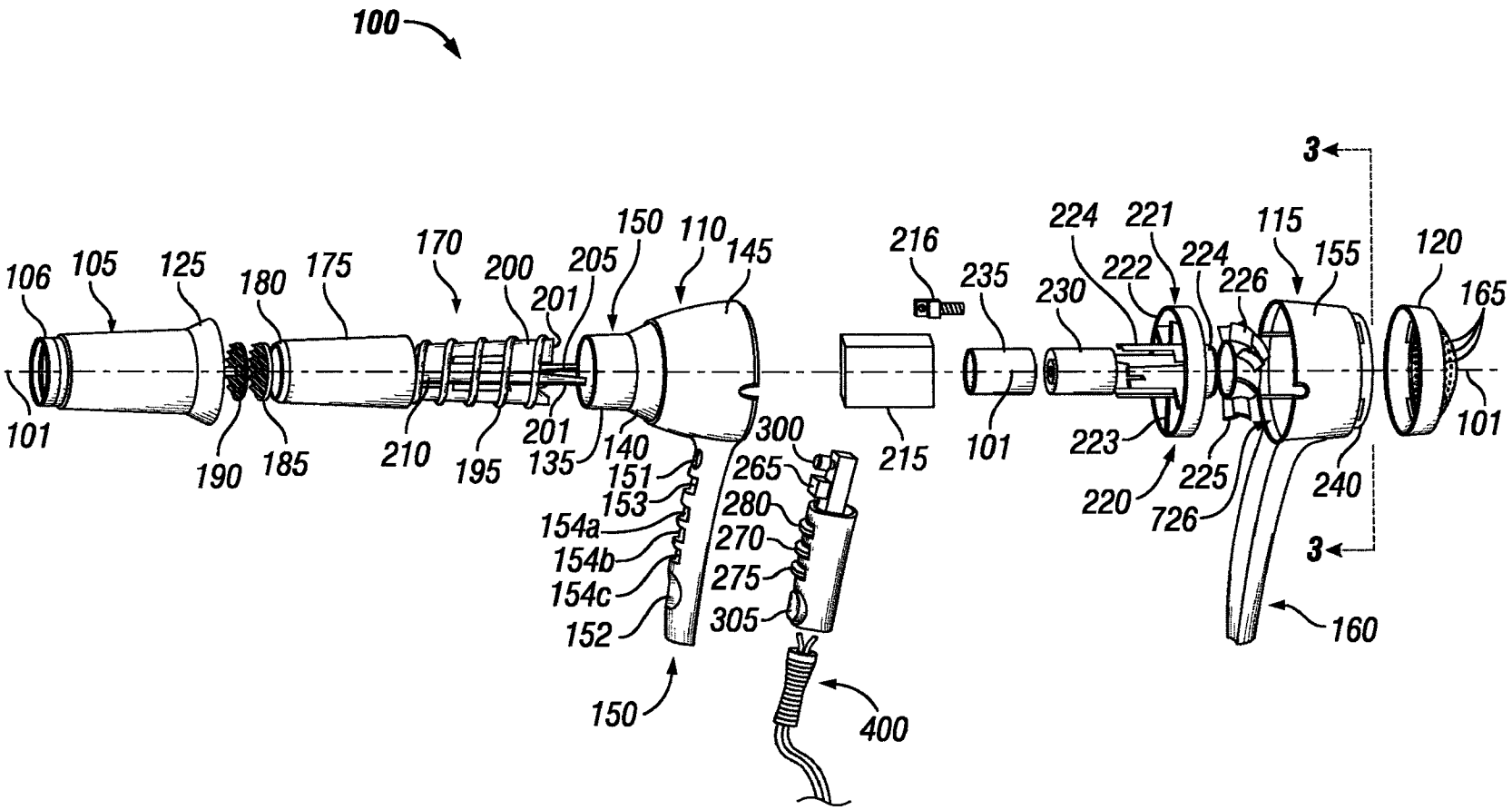
FIG. 1 is an exploded, side view of a hair dryer according to an illustrative embodiment of the present hair dryer.

With reference to FIG. 1, an exploded, side view of a hair dryer 100 is illustrated. The hair dryer 100 may generally include: a nozzle 105; a front housing 110; a rear housing 115; and a rear cap 120. Preferably, the nozzle 105, front housing 110, rear housing 115, and rear cap 120 are made from any suitable material having the requisite strength and heat resistance properties to function in a hair dryer, such as such as any suitable metal, metal alloy, or plastic material, as are known in the art.

The nozzle 105 may be of a general cylindrical shape and may include a flared end 125 for engagement with the front housing 110. In an embodiment, the nozzle 105 and flared end 125 are integral with each other and formed from a single plastic mold. In another embodiment, the nozzle 105 and flared end 125 may be separate parts affixed to each other by any suitable means, including glue, screws, mating screw threads, snaps, friction fit, and/or male/female tabs. The nozzle 105 may be affixed to the front housing 110 by any means, including glue, screws, mating screw threads, snaps, friction fit, and/or male/female tabs.

The front housing 110 may further include a front housing, generally truncated, conical portion 145 and a front handle portion 150 affixed to the front housing truncated conical portion 145. The front handle portion 150, preferably extends downwardly in a direction away from the front housing truncated conical portion 145 to form the front half of the hair dryer's handle. In an embodiment, the front housing 110 generally includes: a generally cylindrical shaped extension, or front extension, 135; a front housing generally flared portion 140; a front housing generally truncated conical portion 145; and a front handle portion 150, all of which are preferably formed integral with each other and formed from a single plastic mold. In another embodiment, the front extension 135, front housing flared portion 140, front housing truncated conical portion 145, and front handle portion 150 may be separate parts affixed to, or associated with, each other by any suitable means, including glue, screws, mating screw threads, snaps, friction fit, and/or male/female tabs. The front housing 110 may be affixed to, or associated with, the rear housing 115 by any suitable means, including glue, screws, mating screw threads, snaps, friction fit, and/or male/female tabs, to form a housing for the components of the hair dryer 100 as will be hereinafter described.

The rear housing 115 may include a rear housing, generally truncated, conical portion 155 and a rear handle portion 160 affixed to the rear housing truncated conical portion 155. The rear handle portion 160, preferably extends downwardly in a direction away from the rear housing truncated conical portion 155 to form the back half of the hair dryer's handle. In an embodiment, the rear housing truncated conical portion 155 and rear handle portion 160 may be formed integral with each other and formed from a single plastic mold. In another embodiment, the rear housing truncated conical portion 155 and rear handle portion 160 may be separate parts affixed to each other by any suitable means or techniques, including glue, screws, mating screw threads, snaps, friction fit, and/or male/female tabs. The front handle portion 150 and rear handle portion 160 may be affixed, or secured, to each other by any suitable means, including glue, screws, mating screw threads, snaps, friction fit, and/or male/female tabs.

The rear cap 120 may be affixed to the rear housing 115 by any suitable means, including glue, screws, snaps, friction fit, and/or male/female tabs. In an embodiment, the rear housing 115 and rear cap 120 include mating screw threads such that the rear cap 120 may be screwed onto the rear housing 115. Preferably, the rear cap 120, includes perforations 165 to allow air to flow into the hair dryer 100.

The nozzle 105 and at least a portion of the front housing 110 preferably house a heater assembly 170 and its component parts, hereinafter described in greater detail, and a primary thermal insulator 175. The nozzle 105 and at least a portion of the front housing 110 may additionally house: a secondary thermal insulator 180; a ceramic insert 185; and a finger guard 190. The finger guard 190, which is disposed within the exit end 106 of nozzle 105, serves to prevent any foreign objects, for example human fingers, from entering the nozzle 105 of the hair dryer 100.

Still with reference to FIG. 1, the heater assembly 170 may include a heating element 195 wound about a heating frame 200. The heating frame 200 may be of any shape or cross-sectional configuration, and may be formed from any material having the requisite strength and heat resistance properties for use in a hair dryer, such as a suitable metal, metal alloy, plastic, ceramic, and/or mica material. A preferable configuration of the heating frame 200 is an "X" shaped cross-sectional configuration, when viewed along the longitudinal axis 101 of hair dryer 100. The heating frame is further preferably formed of at least two rectangular-shaped plate members 201, which are disposed substantially perpendicular to each other and substantially disposed in planes coplanar with the longitudinal axis 101 of the hair dryer 100. This configuration may provide rigidity when the heating element 195 is wound about the heating frame 200, and uses a minimal amount of material.

The primary thermal insulator 175, preferably has a generally cylindrical configuration, and may be sized to snugly house, or contain, the heating frame 200, adding further rigidity. The primary thermal insulator 175 may be made from any material having the requisite strength, heat resistance, and insulating properties for use in a hair dryer, such as a suitable metal, metal alloy, plastic, ceramic, and/or mica material. Preferably, the primary thermal insulator 175 insulates the heat, or prevents the heat, generated by the heating element from being readily transmitted to the interior wall surfaces of the nozzle 105 and the front housing 110 to prevent the outer wall surfaces of the nozzle 105 and the front housing 110 from being too hot to the touch of users of the hair dryer 100. A secondary insulator 180 may be further provided to engage and be disposed in a concentric relationship with and within the primary insulator 175. The secondary insulator 180, if present, may serve to assist the primary insulator 175 to prevent the outer wall surfaces of the nozzle 105 and the front housing 110 from being too hot to the touch of users of the hair dryer 100. Additionally, and without wishing to be bound by the theory, the secondary insulator 180, if present, may be made from any material which may reduce any electromagnetic fields ("EMF") emitted by the hair dryer 100, including any extremely low frequency ("ELF") electromagnetic fields emitted by the hair dryer 100. In an embodiment, the secondary insulator 180 may be made from materials such as: a metal selected from the group consisting of steel, iron, gold, silver, and the like; plastic; metal alloy; ceramic; or mica.

Still with reference to FIG. 1, the front housing 110 and rear housing 115 may house, or include, a mounting member 220, a fan 225, and a motor 230, as well as various electrical components, hereinafter described in more detail, and the electrical components may be generally housed between the front handle portion 150 and the rear handle portion 160. Preferably, the mounting member 220 is used to mount the fan 225 and the motor 230 within the hair dryer 100. The mounting member 220 is preferably made from any suitable material having the requisite strength properties to function in a hair dryer, such as such as any suitable metal, metal alloy, or plastic material. Mounting member 220 generally includes a spider member 221 having an outer annular-shaped ring 222 supported by a plurality of vanes 223. Along the longitudinal axis 101 of the hair dryer 100, disposed at the center of the spider member 221, and connected to the vanes 223 is a generally cylindrical-shaped shaft 224 upon which the fan 225 and motor 230 may be mounted. The ring 222 is preferably snugly received within either the front housing 110, rear housing 115, or both. The generally cylindrical-shaped shaft 224 is further preferably shaped to receive on a forward end the motor 230 and on a rear end the fan 225.

The fan 225 is preferably made from any suitable material having the requisite strength properties to function in a hair dryer, such as such as any suitable metal, metal alloy, or plastic material. Preferably, the fan 225 is formed of a plastic material, and the plastic which forms the fan 225 has a uniform density such that the weight of the fan 225 is balanced; otherwise, modification of the blades of the fan 225 may be required to balance the fan in weight in order to optimize performance while keeping the fan quiet. In an embodiment, the fan blades 226 are preferably thinner at their tip than at the base near the body of the fan 225. The fan 225 may be affixed to the shaft 224 of the mounting member 220 by any suitable means, including glue, screws, snaps, friction fit, and/or male/female tabs; however, the fan 225 should be able to freely rotate within the hair dryer 100, as by mounting it upon a rotatable shaft (not shown) rotated by a motor 230.

The motor 230 is preferably a dc motor, but may be an ac motor. The motor 230 may be affixed to the mounting member 220 by any suitable means, including glue, screws, snaps, friction fit, and/or male/female tabs. In an alternatively embodiment, a motor cover 235 may be provided about the circumference of the motor 230.

A filter 240 may be disposed within the rear housing 115, preferably external to the rear housing 115 and within the rear cap 120. Preferably the filter 240 may be made from any suitable material having the requisite filtration properties to function in a hair dryer, such as such as any suitable mesh metal, mesh polymer, mesh fiber, or plastic material. Without wishing to be bound by the theory, the filter acts to keep foreign objects, such as hair, from entering the hair dryer and causing damage to the hair dryer 100 or causing an undesired odor within the hair dryer 100.

Still with reference to FIG. 1, the heater assembly 200 may include: a thermal fuse 205; a bi-metal switch 210; an ion generator 215; and an ozone generator 216. In an alternative embodiment, the heater assembly 200 may include a thermal fuse 205 and a bi-metal switch 210, and the mounting member 220 may include an ion generator 215 and an ozone generator 216. In a still further embodiment, the ion generator 215 and the ozone generator 216 are associated with, affixed to, or otherwise supported by both the heater assembly 200 and the mounting member 220 and/or the generally cylindrical-shaped shaft 224. In another embodiment, the ion generator 215 functions to produce both ions and ozone and the ozone generator 216 is not present.

The thermal fuse 205 and bi-metal switch 210 may serve to ensure that if the heating element 195 exceeds a pre-determined temperature, the hair dryer 100 shuts off. If the thermal fuse 205 reaches a temperature above a pre-determined temperature, or its set point, the thermal fuse 205 may temporarily disable the electrical current flowing to the heating element 195, causing the hair dryer 100 to cease producing heat until the temperature reaches a safe level. If the bi-metal switch 210 reaches a temperature above its set point, the circuit may permanently break indicating an unsafe condition in the hair dryer 100 and preventing its further use. The set point of the bi-metal switch 210 is preferably greater than that of the thermal fuse 205.

The ion generator 215 may be any suitable apparatus that is both capable of generating ions and sized to be received within the hair dryer 100. In an embodiment, the ion generator 215 is a spark gap having two, or more, conducting electrodes separated by a gap. The gap may be filled with a gas, such as air. When a voltage ranging between about 200 to about 2000 volts is supplied, a spark may form, and at least a portion of the gas within the gap may become ionized. In this manner, the ion generator 215 may produce ions during the operation of the hair dryer 100. Without wishing to be bound by the theory, Applicants believe that transmitting ions to the hair has advantageous effects on the hair shaft, which make it more manageable.

The ozone generator 216 may be any suitable apparatus that is both capable of generating ozone and sized to be received within the hair dryer 100. In an embodiment, the ozone generator 216 is a high-voltage charged plate having two, or more, charged plates separated by a gap. The gap may be filled with a gas, such as air, or an insulator such as glass or ceramic. When a voltage ranging between about 5500 to about 7000 volts is supplied, at least a portion of the oxygen in the air can form ozone. In this manner, the ozone generator 216 may produce ozone. Without wishing to be bound by the theory, Applicants believe that an accumulation of ozone may sanitize at least a portion of the internal components of the hair dryer 100 as the ozone moves from the ozone generator 210 forward into the nozzle 105 and rearward into the housing 120 during a timed sterilization period. The ozone may be moved by either diffusion to accumulate within the housings when the fan 225 is off, or by the fan 225, which is used to draw air into the hair dryer 100, and blow the air through the hair dryer 100 toward the nozzle 105. Preferably, the ozone generator is operated 216 while the heating element 195 is turned off.

In an alternative embodiment, the ion generator 215 is a spark gap capable of receiving voltage at either a range between about 200 to about 2000 volts or a voltage ranging between about 3300 to about 7000 volts, and thus functions as both an ion generator at low voltage and an ozone generator at high voltage. In embodiments wherein the ion generator 215 can function as both an ion and ozone generator, the ozone generator 216 may be absent. In these embodiments, the ion generator 215 may also produce ozone. Without wishing to be bound by the theory, Applicants believe that an accumulation of ozone may sanitize at least a portion of the internal components of the hair dryer 100 as the ozone moves from the ion generator 215 forward into the nozzle 105 and rearward into the housing 120 during a timed sterilization period. The ozone may be moved by either diffusion to accumulate within the housings when the fan 225 is off, or by the fan 225, as previously described. Preferably, when the ion generator 215 produces ozone it operates while the heating element 195 is turned off.

Figure 3:
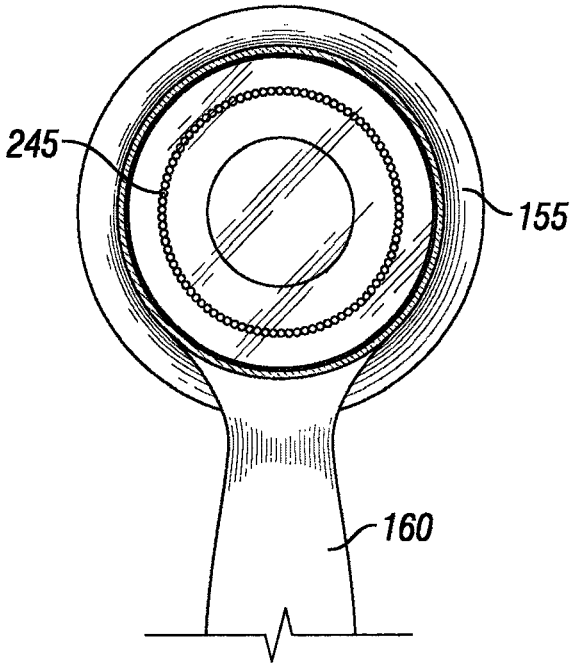
FIG. 3 is a rear view of a portion of the hair dryer taken along cut-line 3-3 of FIG. 1.

With reference to FIGS. 1 and 3, in an embodiment, one or more, and preferably an array of between about 5 and 15, alternatively between about 5 and 10, ultra-violet light emitting diodes ("UV LED") 245 may be associated with the rear housing 115, as by affixing the UV LEDs 245 to, or otherwise disposing them within, the rear housing 115. Alternatively, the UV LEDs 245 may be mounted in a generally circular array to the back end of the truncated conical portion 155, and oriented to point toward the rear cap 120. In an alternative embodiment, the UV LEDs 245 may be oriented to point toward both the rear cap 120 and forward toward the fan 225 and nozzle 105. In the embodiment wherein the UV LEDs 245 are oriented toward the fan 225, the blue ultra-violet light emitted from the UV LEDs 245 may sanitize at least a portion of the interior of the housing, the fan blades 226 and all exposed component surfaces disposed between the rear cap 120 and the exit end 106 of the nozzle 105.

The UV LEDs 245 may emit blue ultra-violet light having wavelengths ranging from about 405 to about 415 nanometers. The blue ultra-violet light may be emitted continuously, in regular pulses, or in irregular pulses. In an embodiment, the intensity of the UV LEDs 245 may be sufficient to kill bacteria, mold, fungus, and certain viruses within about 2 to about 6 hours of exposure, and without negative human eye hazard and without carcinogenic effects. Without wishing to be bound by the theory, Applicants believe that when arranged and oriented to point toward the rear cap 120, the blue ultra-violet light emitted from the UV LEDs 245 sanitizes at least a portion of the interior of the rear cap 120 and the filter 240 disposed between the rear cap 120 and the rear housing 115.

In an embodiment, the UV LEDs 245 may be used in combination with the ozone produced within either the ion generator 215 or the ozone generator 216 to sanitize at least a portion of the interior of the hair dryer 100. In this manner, the hair dryer 100 may be internally sterilized against microbes using two mechanisms: 1) light absorption; and 2) chemical degradation. The microbes susceptible to sterilization may include bacteria, mold, yeast, fungi, and some viruses. Without wishing to be bound by the theory, Applicants believe that the combination of the two sterilization mechanisms has a synergistic effect, thereby sanitizing the interior of the hair dryer 100 with great efficiency.

With reference to FIG. 1, the ceramic insert 185 may be made of a solid ceramic composition. In another embodiment, the ceramic insert 185 may include a ceramic, metal, or plastic core with a coating of polysiloxane and ceramic composition. In an embodiment, the ceramic composition may include at least 16 metal ions in an organic solvent. In another embodiment, the ceramic composition may include metal ions, and preferably at least 16 metal ions suspended in an organic solvent. The 16 metal ions of the ceramic composition may include aluminum, calcium, titanium, chromium, manganese, iron, copper, strontium, barium, lanthanum, cerium, praseodymium, neodymium, lead, thorium, and silicon.

Preferably, the ceramic composition may include about 10.5 aluminum normalized weight percent, based on the total weight percent of metal ions in the ceramic composition, and the normalized weight percent of aluminum may range from between about 0.1 to about 40 percent. Preferably, the ceramic composition may include about 6.7 calcium normalized weight percent, based on the total weight percent of metal ions in the ceramic composition, and the normalized weight percent of calcium may range from between about 1 to about 35 percent. Preferably, the ceramic composition may include about 15.4 titanium normalized weight percent, based on the total weight percent of metal ions in the ceramic composition, and the normalized weight percent of titanium may range from between about 5 to about 55 percent. Preferably, the ceramic composition may include about 10 chromium normalized weight percent, based on the total weight percent of metal ions in the ceramic composition, and the normalized weight percent of chromium may range from between about 1 to about 35 percent.

Preferably, the ceramic composition may include about 1.9 manganese normalized weight percent, based on the total weight percent of metal ions in the ceramic composition, and the normalized weight percent of manganese may range from between about 0.1 to about 45 percent. Preferably, the ceramic composition may include about 7.1 iron normalized weight percent, based on the total weight percent of metal ions in the ceramic composition, and the normalized weight percent of iron may range from between about 2 to about 45 percent. Preferably, the ceramic composition may include about 4.1 copper normalized weight percent, based on the total weight percent of metal ions in the ceramic composition, and the normalized weight percent of copper may range from between about 2 to about 35 percent. Preferably, the ceramic composition may include about 1.1 strontium normalized weight percent, based on the total weight percent of metal ions in the ceramic composition, and the normalized weight percent of strontium may range from between about 0.01 to about 10 percent.

Preferably, the ceramic composition may include about 22.1 barium normalized weight percent, based on the total weight percent of metal ions in the ceramic composition, and the normalized weight percent of barium may range from between about 3 to about 55 percent. Preferably, the ceramic composition may include about 1.9 lanthanum normalized weight percent, based on the total weight percent of metal ions in the ceramic composition, and the normalized weight percent of lanthanum may range from between about 0.1 to about 5 percent. Preferably, the ceramic composition may include about 3.6 cerium normalized weight percent, based on the total weight percent of metal ions in the ceramic composition, and the normalized weight percent of cerium may range from between about 0.1 to about 10 percent. Preferably, the ceramic composition may include about 0.4 praseodymium normalized weight percent, based on the total weight percent of metal ions in the ceramic composition, and the normalized weight percent of praseodymium may range from between about 0.01 to about 5 percent.

Preferably, the ceramic composition may include about 1.3 neodymium normalized weight percent, based on the total weight percent of metal ions in the ceramic composition, and the normalized weight percent of neodymium may range from between about 0.2 to about 10 percent. Preferably, the ceramic composition may include about 0.1 lead normalized weight percent, based on the total weight percent of metal ions in the ceramic composition, and the normalized weight percent of lead may range from between about 0.01 to about 3 percent. Preferably, the ceramic composition may include about 1 thorium normalized weight percent, based on the total weight percent of metal ions in the ceramic composition, and the normalized weight percent of thorium may range from between about 0.01 to about 3 percent. Preferably, the ceramic composition may include about 23.3 silicon normalized weight percent, based on the total weight percent of metal ions in the ceramic composition, and the normalized weight percent of silicon may range from between about 5 to about 45 percent.

Without wishing to be bound by the theory, it is believed that when hot air passes over the ceramic insert 185, far infrared heat (thermal waves) are caused to be transferred through the ceramic composition, and, anions, or positive ions, are generated and transmitted to the hair having advantageous effects on the hair shaft, which make it more manageable. Further, without wishing to be bound by the theory, the far infrared heat dries strands of hair from the inside of the strand of hair outwardly to the outside surface of the hair shaft, which is beneficial to the stands of hair by reducing the incidence by which ends of the stands of hair split, i.e., drying hair by far infrared heat reduces split ends.

Figure 2:
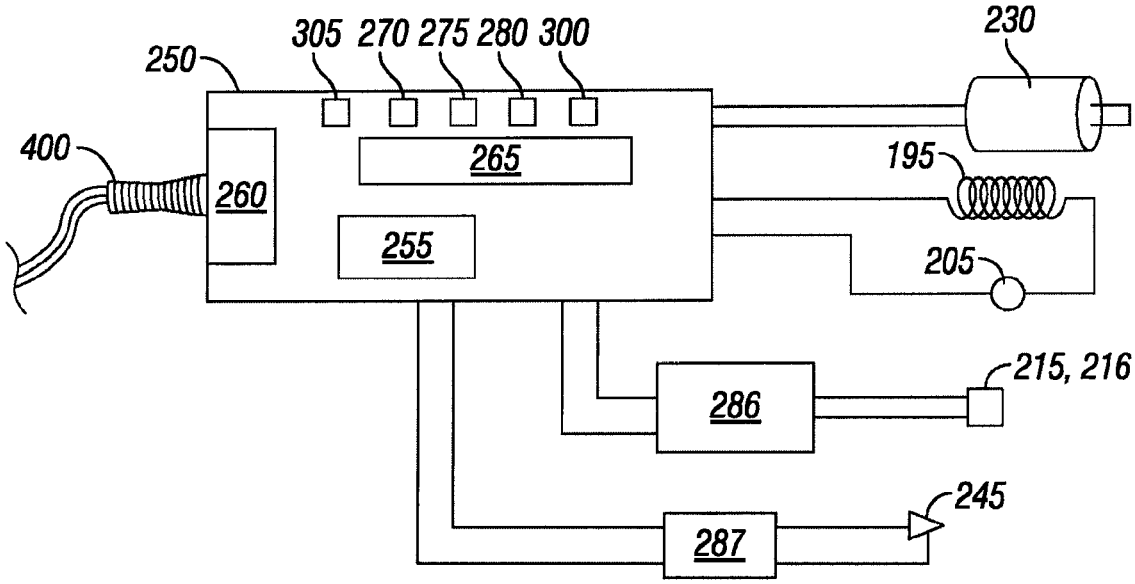
FIG. 2 is a schematic diagram illustrating the electronic circuitry of an illustrative embodiment of a hair dryer according to an illustrative embodiment of the present hair dryer.

With reference to FIGS. 1 and 2, a circuit board 250 may be associated with, or otherwise housed in the hair dryer 100, such as within the handle formed by the front handle portion 150 and the rear handle portion 160. The circuit board 250 may by adapted to receive ac current at 120 or 220 volts from a power cord 400 and through a voltage regulator 260 associated with the circuit board 250. In an embodiment, the voltage regulator 260 is affixed to the circuit board 250. Further, in electrical, or electronic, association with the circuit board 250 may be the following elements: at least one microprocessor 255; at least one liquid crystal display ("LCD") 265; at least three and optionally four, five, six or more control buttons, dials, or switches 270, 275, and 280 (fourth, fifth, and sixth buttons not shown); a cold shot control button 300; a sterilization, or sanitizing, control button 305; at least one high voltage generator 286; and at least one light emitting diode ("LED") power supply 287.

In an embodiment, the following elements may be affixed to the circuit board 250 and in electrical communication therewith: the voltage regulator 260; the microprocessor 255; at least one LCD 265; at least three buttons, dials, or switches 270, 275, and 280; at least one high voltage generator 286; and at least one LED power supply 287. In an alternative embodiment, due to physical spacing considerations, the at least one high voltage generator 286 and/or the at least one LED power supply 287 may be in electrical communication with the circuit board 205, and disposed elsewhere within the hair dryer 100. In an embodiment, the following components may be in electrical communication with the circuit board 250 and disposed within the hair dryer 100: the heating element 195; the motor 230; the ion generator 215; the ozone generator 216; and the thermal fuse 205.

The front housing 110 may include apertures 151, 152, 153, and 154*a*, 154*b*, and 154*c* through which the following components may be exposed: a cold shot control button 300; a LCD 265; the control buttons, dials, switches, 280, 270, 275; and the sanitizing control button 305, respectively. Alternatively, the cold shot control button 300, control buttons, dials, or switches 280, 270, and 275, and sanitizing control button 305 may be level with, or recessed within, respective apertures in the front housing 110. Moreover, in a preferred embodiment, the force to depress each control button may be high enough to minimize unintentional depression of each control button, yet low enough to allow ease of depression. Accordingly, the force needed to depress each control button may range from about 100 grams force to 310 grams force, alternatively from about 150 grams force to about 260 grams force, and alternatively about 200 grams force, plus or minus 50 grams force.

Depressing the cold shot control button 300, may signal the hair dryer 100 to turn on the motor 230, which drives the fan 225 to move relatively cold, or room temperature, air, into the hair dryer 100 and through the nozzle 105. Alternatively, depressing the cold shot control button 300 may send an electrical signal to the motor 230 through the microprocessor 225, which keeps the fan 225 running, and sends an electrical signal to the heating element 195, which turns off, or keeps off, the heating element 195.

Depressing the sanitizing button control 305 may activate the sanitization mode, which may send electrical signals through the microprocessor 255 to do the following: 1) deactivate electrical power to the motor 230; 2) deactivate electrical power to the heating element 195; 3) activate the high voltage generator 286, which provides electrical power, ranging from about 5500 volts to about 8000 volts, to the ion generator 215 or the ozone generator 216 to generate ozone; and 4) activate the low voltage LED power supply 287, which provides electrical power, ranging from about 3.0 to about 5.5 volts, to the UV LEDs 245 to emit ultra-violet light. In an embodiment, the microprocessor 255 may have a timing feature and may automatically turns off the UV LEDs 245 and the ozone producing element, either the ion generator 215 or the ozone generator 216, after a predetermined amount of time, ranging between 1 minute and six hours, preferably between two hours and six hours, sufficient to sanitize at least an internal portion of the hair dryer 100. Preferably, the sanitization mode may be stopped before the aforementioned predetermined amount of time by depressing the sanitizing control button 305 a second time.

In an embodiment, various control buttons may be assigned a function: an up button 270, a down button 275, and a power button 280. Depressing at least two of the buttons (preferably the up and down buttons) at the same time may trigger a fourth mode function. Alternatively, the fourth mode function may have its own button.

Depressing the power control button 280 may turn the hair dryer 100 on and off. Depressing the mode button, or otherwise engaging the mode function may allow the user to control various functions of the hair dryer 100, including setting the hair dryer 100 to turn off after a set amount of time, setting the hair dryer 100 to turn off after reaching a set temperature, turning the ion generator 215 on, keeping the ion generator 215 on for a certain amount of time, activating the sanitizing mode (described above) through the microprocessor, and increasing or decreasing the temperature of the heating element 195. Depressing, or otherwise engaging, the mode button may also allow the user to observe various information, including the current temperature of the heating element 195 in degrees Fahrenheit, Centigrade, Kelvin, or Rankin, the total number of hours and/or minutes that the hair dryer has been used, the total number of hours and/or minutes that the hair dryer has been used during a session, the total amount of hours and/or minutes that the ionic generator has been used, as well as the serial number of the hair dryer.

Depending on the mode that the hair dryer is in, depressing the up button 270 may have different functions. For example, if the hair dryer is in "temperature mode," depressing the up button 270 may increase the temperature of the heating element 195 by a set amount, as regulated by a thermister (not shown), typically one degree, or any other desired increment of temperature. Similarly, if the hair dryer is in "temperature mode," depressing the down button 275 may decrease the temperature of the heating element 195 by a set amount, as regulated by the thermister (not shown), typically one degree, or any other desired increment of temperature. If the thermister fails and the heating element 195 gets too hot, the thermal fuse 205 preferably trips, which causes the hair dryer 100 to turn off.

In another example, if the hair dryer 100 is in "timing mode," depressing the up button 270 may increase the amount of time that the hair dryer will stay on before shutting off, and depressing the down button 275 may decrease the amount of time that the hair dryer will stay on before shutting off. In alternative embodiments, the buttons may be replaced by rotatable dials, switches, and the like.

A power cord 400 may be secured between the lower end of the front handle portion 150 and rear handle portion 160 and provide electrical power via the voltage regulator 260 to the circuit board 250 and the remainder of the electrical components of the hair dryer 100.

Specific embodiments of the present hair dryer have been described and illustrated. It will be understood to those skilled in the art that changes and modifications may be made without departing from the spirit and scope of the inventions defined by the appended claims.

We claim:

1. A method of sanitizing an interior of a hair dryer, the hair dryer having a nozzle, a housing, a fan, and a heating element enclosed within said housing, an ozone producing component disposed within said housing intermediate the fan and the nozzle, and a plurality of ultraviolet (UV) light emitting diodes disposed intermediate the fan and a rear end of the housing configured to emit UV light within said housing, said method comprising the steps of:

(a) de-energizing said fan and said heating element for a sanitizing period of time;

(b) generating ozone within said housing with the ozone producing component while said fan and said heating element are de-energized for the sanitizing period of time; and (c) illuminating at least one of the fan and an interior surface of the rear end of the housing with the ultraviolet light emitting diodes for the sanitizing period of time.

2. The method of claim 1, wherein the ozone producing component is an ion generator.

3. The method of claim 1, wherein the sanitizing period of time is from about 1 minute to about 6 hours.

4. The self-sanitizing hair dryer of claim 3, wherein each of said plurality of UV LEDs emits in a wavelength between about 405 nm to about 415 nm.

5. The self-sanitizing hair dryer of claim 4, wherein said plurality of UV LEDs comprises between about 5 and 15 UV LEDs.

6. The self-sanitizing hair dryer of claim 5, wherein said ozone generator is an ion generator.

7. A self-sanitizing hair dryer having a fan for drawing ambient air into a housing, and impelling the air through a nozzle, and a heating element for heating the impelled air, said self-sanitizing hair dryer further comprising:

(a) a high voltage generator disposed within said housing suitable for generating voltages of between about 5500 Volts to about 8000 Volts;

(b) an ozone generator responsive to said high voltage generator disposed within said housing intermediate the fan and the nozzle;

(c) a microprocessor configured to control energizing and de-energizing of said heating element, said fan, and said ozone generator, and configured with a timing function; and (d) a user control interface configured to allow a user to command said microprocessor to enter into a sanitizing mode; and wherein upon receiving said user command, said microprocessor is configured to de-energize said fan and said heating element and to simultaneously energize said ozone generator to generate ozone within said chamber to sanitize interior surfaces thereof while said fan and said heating element are de-energized for a sanitizing period, said sanitizing period being between about 1 minute and about 6 hours.

8. The hair dryer of claim 7, further comprising a plurality of ultra-violet light emitting diodes (UV LEDs) for emitting UV light into said housing disposed on an upstream side of said fan and responsive to said microprocessor such that said UV LEDs are energized during said sanitizing period.

9. The hair dryer of claim 8, wherein the plurality of UV LEDs are disposed in a substantially circular shaped array.

10. The hair dryer of claim 9, wherein the nozzle has a ceramic insert, and wherein the ceramic insert is comprised of at least one metal ion, the at least one metal ion is selected from the group consisting of aluminum, calcium, titanium, chromium, manganese, iron, copper, strontium, barium, lanthanum, cerium, praseodymium, neodymium, lead, thorium, and silicon.

11. The hair dryer of claim 10, wherein the ceramic insert is comprised of at least aluminum metal ions, calcium metal ions, titanium metal ions, chromium metal ions, manganese metal ions, iron metal ions, copper metal ions, strontium metal ions, barium metal ions, lanthanum metal ions, cerium metal ions, praseodymium metal ions, neodymium metal ions, lead metal ions, thorium metal ions, and silicon metal ions.

12. The hair dryer of claim 10, wherein is ceramic insert is a generally shaped as a disk.

* * * * *